US011885210B2

(12) United States Patent
Soliman et al.

(10) Patent No.: US 11,885,210 B2
(45) Date of Patent: Jan. 30, 2024

(54) WATER SEPARATION AND INJECTION

(71) Applicant: Saudi Arabian Oil Company, Dhahran (SA)

(72) Inventors: Mohamed Ahmed Soliman, Ras Tanura (SA); Azeb M. Qahtani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/664,172

(22) Filed: May 19, 2022

(65) Prior Publication Data

US 2023/0374895 A1 Nov. 23, 2023

(51) Int. Cl.

| | |
|---|---|
| ***E21B 43/38*** | (2006.01) |
| ***E21B 41/00*** | (2006.01) |
| ***E21B 34/16*** | (2006.01) |
| ***E21B 36/00*** | (2006.01) |

(52) U.S. Cl.

CPC ..... *E21B 43/385* (2013.01); *E21B 34/16* (2013.01); *E21B 36/001* (2013.01); *E21B 41/0085* (2013.01)

(58) Field of Classification Search

None

See application file for complete search history.

(56) References Cited

U.S. PATENT DOCUMENTS

| | | | | |
|---|---|---|---|---|
| 2,245,028 | A * | 6/1941 | Farris | E21B 43/34 62/633 |
| 8,573,306 | B2 | 11/2013 | Donald et al. | |
| 9,975,789 | B2 | 5/2018 | Ghasripoor et al. | |
| 10,648,314 | B2 | 5/2020 | Unnam et al. | |
| 2003/0070813 | A1* | 4/2003 | Irwin, Jr. | E21B 43/122 166/372 |

(Continued)

FOREIGN PATENT DOCUMENTS

| | | |
|---|---|---|
| EP | 2497556 | 9/2012 |

OTHER PUBLICATIONS

Devold, "Oil and gas production handbook: An introduction to oil and gas production, transport, refining and petrochemical industry," ABB Oil and Gas, Aug. 2013, retrieved on Apr. 29, 2022, retrieved from URL <https://library.e.abb.com/public/34d5b70e18f7d6c8c1257be500438ac3/Oil%20and%20gas%20production%20handbook%20ed3x0_web.pdf>, 162 pages.

*Primary Examiner* — Kristyn A Hall

(74) *Attorney, Agent, or Firm* — Fish & Richardson P.C.

(57) ABSTRACT

A water separation system includes a production control valve fluidly connected to a production tubing and positioned at an uphole end of the production tubing at a well head of a well site, a production fluid pathway between the production control valve and a water separator, an injection control valve fluidly connected to an injection tubing and positioned at an uphole end of the injection tubing at the well head, and an injection fluid pathway between the injection control valve and the water separator. The water separator is positioned at the well site and is fluidly connected to the production fluid pathway and the injection fluid pathway. The water separator separates water from the production fluid and directs the separated water to the injection fluid pathway. An output fluid pathway fluidly connects to the water separator to direct the production fluid out of the water separator.

26 Claims, 12 Drawing Sheets

(56) References Cited

U.S. PATENT DOCUMENTS

| | | | | |
|---|---|---|---|---|
| 2007/0051513 | A1* | 3/2007 | Heins | E21B 43/40 166/265 |
| 2012/0175103 | A1* | 7/2012 | Donald | E21B 43/16 166/97.1 |
| 2016/0367915 | A1* | 12/2016 | Melnyk | E21B 21/065 |
| 2017/0057836 | A1* | 3/2017 | Rajagopalan | B01D 5/006 |
| 2018/0370834 | A1 | 12/2018 | Sutton-Sharp | |
| 2023/0016334 | A1* | 1/2023 | Chorn | E21B 43/305 |

* cited by examiner

WATER SEPARATION AND INJECTION

TECHNICAL FIELD

This disclosure relates to water separation systems for use in hydrocarbon production wells.

BACKGROUND

Hydrocarbon wells are used to access and extract hydrocarbons from subterranean hydrocarbon reservoirs. The hydrocarbons produced from these reservoirs are often saturated with water, such as entrained formation water from the reservoirs. The produced water and hydrocarbon gas or fluid is transported across a pipeline to a downstream processing plant for water separation and process gas treatment. The separated water is then transported across a second pipeline back to the wellbore for reinjection back into the reservoir.

SUMMARY

This disclosure describes well systems with water separation systems for separating water from a wellbore production fluid and reinjecting the separated water back into a reservoir.

In some aspects, a water separation system for a well includes a production control valve fluidly connected to a production tubing and positioned at an uphole end of the production tubing at a well head of a well site, a production fluid pathway between the production control valve and a water separator to direct a production fluid from the production control valve to the water separator, an injection control valve fluidly connected to an injection tubing and positioned at an uphole end of the injection tubing at the well head, an injection fluid pathway between the injection control valve and the water separator to direct separated water from the water separator to the injection control valve, the water separator positioned at the well site and fluidly connected to the production fluid pathway and the injection fluid pathway, the water separator to receive the production fluid, separate water from the production fluid, and direct the separated water to the injection fluid pathway, and an output fluid pathway fluidly connected to the water separator to direct the production fluid out of the water separator.

This, and other aspects, can include one or more of the following features. The water separation system can further include a second stage production control valve positioned in the output fluid pathway downstream of the water separator, the second stage production control valve to control a pressure of the production fluid in the output fluid pathway. The water separator can include a knock out drum to separate water from the production fluid. The water separation system can further include a water injection pump in the injection fluid pathway between the knock out drum and the injection control valve, the water injection pump to increase a fluid pressure of the separated water in the injection fluid pathway. The water separation system can further includes a turbocharger fluidly connected to the injection fluid pathway and to the output fluid pathway, the turbocharger to extract energy from the production fluid to boost a pressure of the separated water in the injection fluid pathway. The turbocharger can be disposed in the output fluid pathway in parallel with second stage production control valve. The turbocharger can be disposed in the injection fluid pathway in parallel with a bypass valve in the injection fluid pathway. The water separation system can further include a hydraulic recovery turbine in the output fluid pathway, the hydraulic recovery turbine to generate electrical energy from a pressure drop in a flow of the production fluid through the output fluid pathway. The hydraulic recovery turbine can be disposed in the output fluid pathway in parallel with the second stage production control valve. The water separation system can further include a turbocharger fluidly connected to the injection fluid pathway and to one of the output fluid pathway or the production fluid pathway, the turbocharger to extract energy from the production fluid to boost a pressure of the separated water in the injection fluid pathway. The water separator can include an in-line cyclonic separator. The turbocharger can include a pump section and a turbine section rotatably coupled to the pump section, the turbine section to receive a flow of the production fluid, and the pump section to boost pressure of a flow of the separated water. The turbocharger can be fluidly coupled to the injection fluid pathway downstream of the water separator and fluidly coupled to the production fluid pathway upstream of the water separator. The turbocharger can be fluidly coupled to the injection fluid pathway downstream of the water separator and fluidly coupled to the output fluid pathway downstream of the water separator. The water separation system can include a cooler along the production fluid pathway upstream of the water separator, the cooler to decrease a temperature of the production fluid in the production fluid pathway. The water separation system can further include a process control unit communicably connected to the production control valve, the injection control valve, and the output fluid pathway to control a flow of fluid through the water separation system.

Certain aspects of the disclosure encompass a method for water separation at a well site. The method includes directing, with a production fluid pathway, a first flow of a production fluid from a production control valve to a water separator, the production control valve fluidly connected to a production tubing and positioned at an uphole end of the production tubing at a well head of a well site, separating water from the first flow of production fluid with a fluid separator positioned at the well site and fluidly connected to the production fluid pathway, directing, with an injection fluid pathway, a flow of the separated water from the fluid separator to an injection control valve fluidly connected to an injection tubing and positioned at an uphole end of the injection tubing at the well head, and directing, with a output fluid pathway fluidly connected to the water separator, a second flow of the production fluid out of the water separator.

This, and other aspects, can include one or more of the following features. Directing the second flow of production fluid out of the water separator can include controlling a pressure of the second flow of production fluid in the output fluid pathway with a second stage production control valve positioned in the output fluid pathway downstream of the water separator. Separating water from the first flow of production fluid with a fluid separator comprises separating water from the first flow of production fluid with one of a knock out drum or an in-line cyclonic separator. Directing the flow of separated water from the fluid separator to the injection control valve can include boosting, with a turbocharger, a pressure of at least a portion of the flow of separated water in the injection fluid pathway. The turbocharger can be fluidly connected to the injection fluid pathway and to the output fluid pathway, and boosting the pressure of at least a portion of the flow of separated water in the injection fluid pathway can include extracting energy from the second flow of production fluid in the output fluid pathway and transferring the extracted energy to the at least a portion of the flow of separated water with the turbocharger. The turbocharger can be fluidly connected to the injection fluid pathway and to the production fluid pathway, and boosting the pressure of at least a portion of the flow of separated water in the injection fluid pathway can include extracting energy from the first flow of production fluid in the production fluid pathway and transferring the extracted energy to the at least a portion of the flow of separated water with the turbocharger. The method can further include cooling, with a cooler along the production fluid pathway upstream of the water separator, the first flow of production fluid in the production fluid pathway. Directing the second flow of the production fluid out of the water separator can include directing at least a portion of the second flow of the production fluid to a hydraulic recovery turbine disposed in the output fluid pathway, and the method can include generating electrical energy from a pressure drop of the at least a portion of the second flow of the production fluid through the output fluid pathway. The method can further include directing the generated electrical energy from the hydraulic recovery turbine to an electrical component of the well head of the well site. The method can include controlling, with an advanced process controller connected to at least one of the production control valve, the injection control valve, or the output fluid pathway, the flow of fluid through the water separator and through the output fluid pathway.

In certain aspects, a water separation system for a well includes a production fluid pathway between a production tubing at a well head of a well site and a water separator, the production fluid pathway to direct a flow of production fluid from the production tubing to the water separator, an injection fluid pathway between the water separator and an injection tubing at the well head of the well site, the injection fluid pathway to direct a flow of separated water from the water separator to the injection tubing, the water separator positioned at the well site and fluidly connected to the production fluid pathway and the injection fluid pathway, the water separator to receive the flow of production fluid, separate water from the flow of production fluid, and direct the separated water to the injection fluid pathway, an output fluid pathway fluidly connected to the water separator to direct the flow of production fluid out of the water separator, and a process control unit communicably connected to the production fluid pathway, the injection fluid pathway, the water separator, and the output fluid pathway, the process control unit to control a flow of fluid through the water separation system.

This, and other aspects, can include one or more of the following features. The water separation system can further include a turbocharger fluidly connected to the injection fluid pathway and to one of the output fluid pathway or the production fluid pathway, and communicably connected to the process control unit, the turbocharger to extract energy from the production fluid and boost a pressure of the separated water in the injection fluid pathway. The water separation system can further include a hydraulic recovery turbine fluidly connected to the output fluid pathway and communicably connected to the process control unit, the hydraulic recovery turbine to generate electrical energy from a pressure drop in a flow of production fluid through the output fluid pathway.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes water separation systems for water separation and reinjection at a production well site. A water separation system includes a production control valve at a well head of a production tubing, an injection control valve at the well head of a water injection tubing, and a water separator at the well site that fluidly connects to the production control valve and the injection control valve. The control valves can take the form of a choke valve or other type of control valve for controlling a flow through the respective valve. The water separator can take the form of a knock out drum (KOD), an in-line cyclonic separator, or another separator type that separates production fluid (such as hydrocarbon gas, hydrocarbon liquid, or two-phase production hydrocarbons) from water (for example, free water or non-free water from a hydrocarbon reservoir), and feeds the separated water back to the injection control valve, for example, without the need for a water injection pump. In some instances, the water separation system includes a turbocharger to recover potential energy from the production fluid flow, convert the recovered energy to rotational kinetic energy within the turbocharger, and apply that energy to the separated water. This application of energy to the separated water can act to boost a pressure of the separated water flow from the water separator to a pressure level sufficient for reservoir reinjection, for example, without requiring a separate water injection pump to boost the pressure of the separated water. In certain implementations, the water separation system includes a cooler in the production fluid stream between the production control valve and the water separator to condense water and dehydrate the production fluid in the production fluid stream from the well head, for example, to more efficiently and more completely separate the water component from the remainder of the production fluid.

Figure 1:
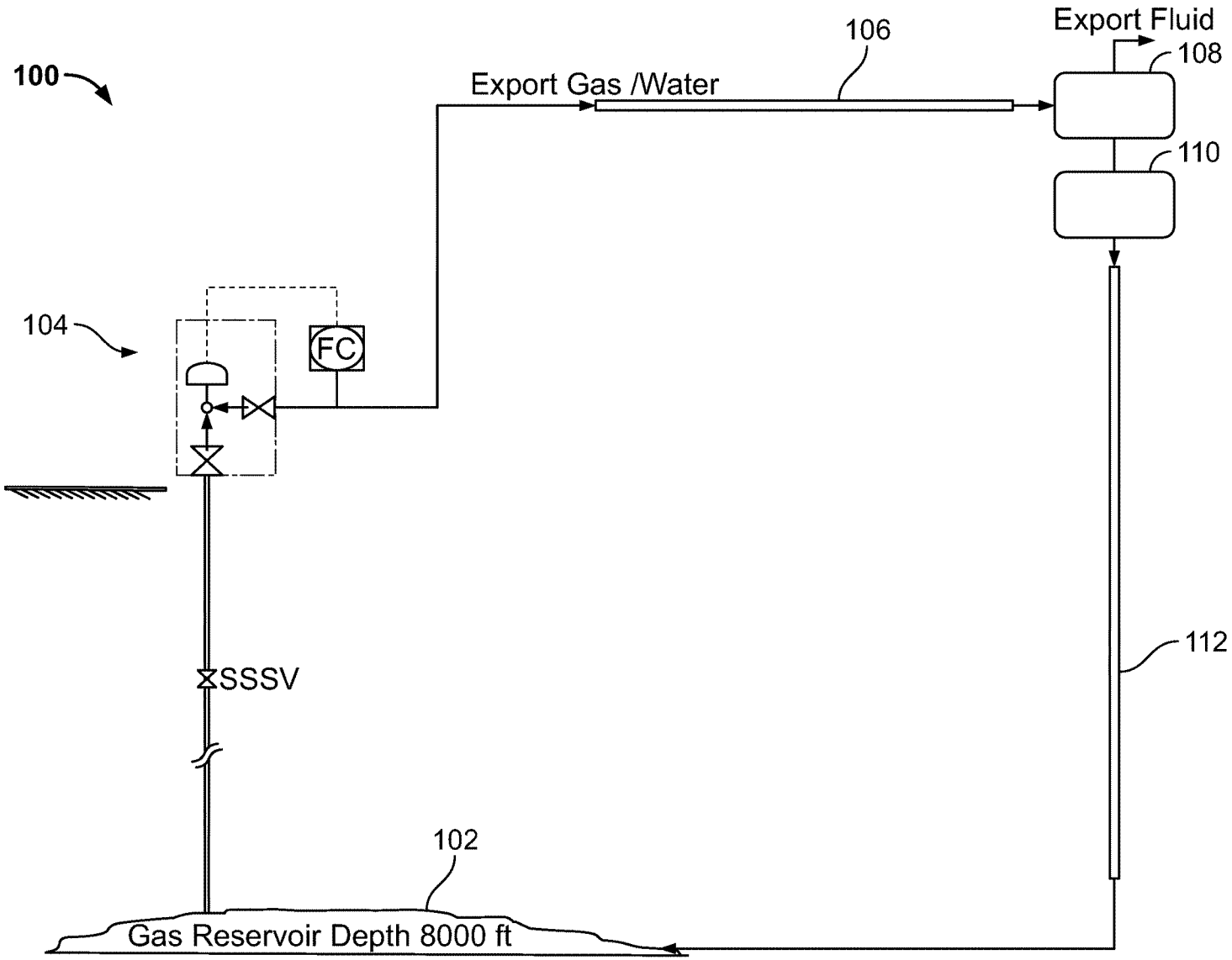
FIG. 1 is a schematic view of an example processing system for a well.

In some conventional water separation and reinjection operations, such as the example processing system 100 of FIG. 1, production flow from a reservoir 102 is directed from a well head 104 through a pipeline 106 to a downstream processing plant 108 at a downstream location far away from the well head itself. The production flow may experience decreases in pressure while traversing longer distances along the pipeline 106. At the processing plant 108, water is separated from the production flow (for example, at a water treatment plant 110 within or adjacent to the processing plant 108). The separated water is then pumped back across a disposal pipeline 112 where it can be reinjected into the reservoir 102. In traversing the longer distances along the disposal pipeline 112, the flow of separated water may require pumps or other components in order to boost the pressure of the separated water to a sufficient level that allows the separated water to traverse the distance of the disposal pipeline 112 and maintain a pressure sufficient for reinjection into the reservoir 102. However, in the water separation systems of the present disclosure, water separation is performed at the production site, for example, at or near the well head of a production well to take advantage of the density and pressure difference between the gas production flow and the water column of an injection well. For example, the density difference between the produced fluid flow out of a production well and separated water from a water separator can be utilized to boost a pressure of the separated water for injection while still maintaining a sufficient pressure in the production fluid flow to reach its target downstream location, such as a hydrocarbon processing facility. In some instances, performing the water separation at the well production site minimizes the pressure drop in the production fluid such that the separated water maintains a higher pressure, for example, as compared to the pressure of separated water from a remote water treatment plant. In addition, separating water from the production fluid flow at the production site minimizes or lessens pipeline corrosion due to its water component, decreases a scraping frequency of pipelines, increases production capacity from the production site to a downstream facility due to the reduction or absence of water from the downstream production pipeline, reduces or eliminates the need for a dedicated disposal pipeline from a remote water treatment plant, ensures that the separated water is compatible with the formation water of the reservoir, or a combination of these benefits, and without adding operational cost to the processing system. In certain instances, the production fluid includes hydrocarbon gas and water, so the separation of water from the hydrocarbon gas at the well site can reduce a capital requirement of transporting the production fluid (since the production fluid would be substantially single phase gas instead of two-phase gas and water), among other benefits mentioned earlier.

Figure 2:
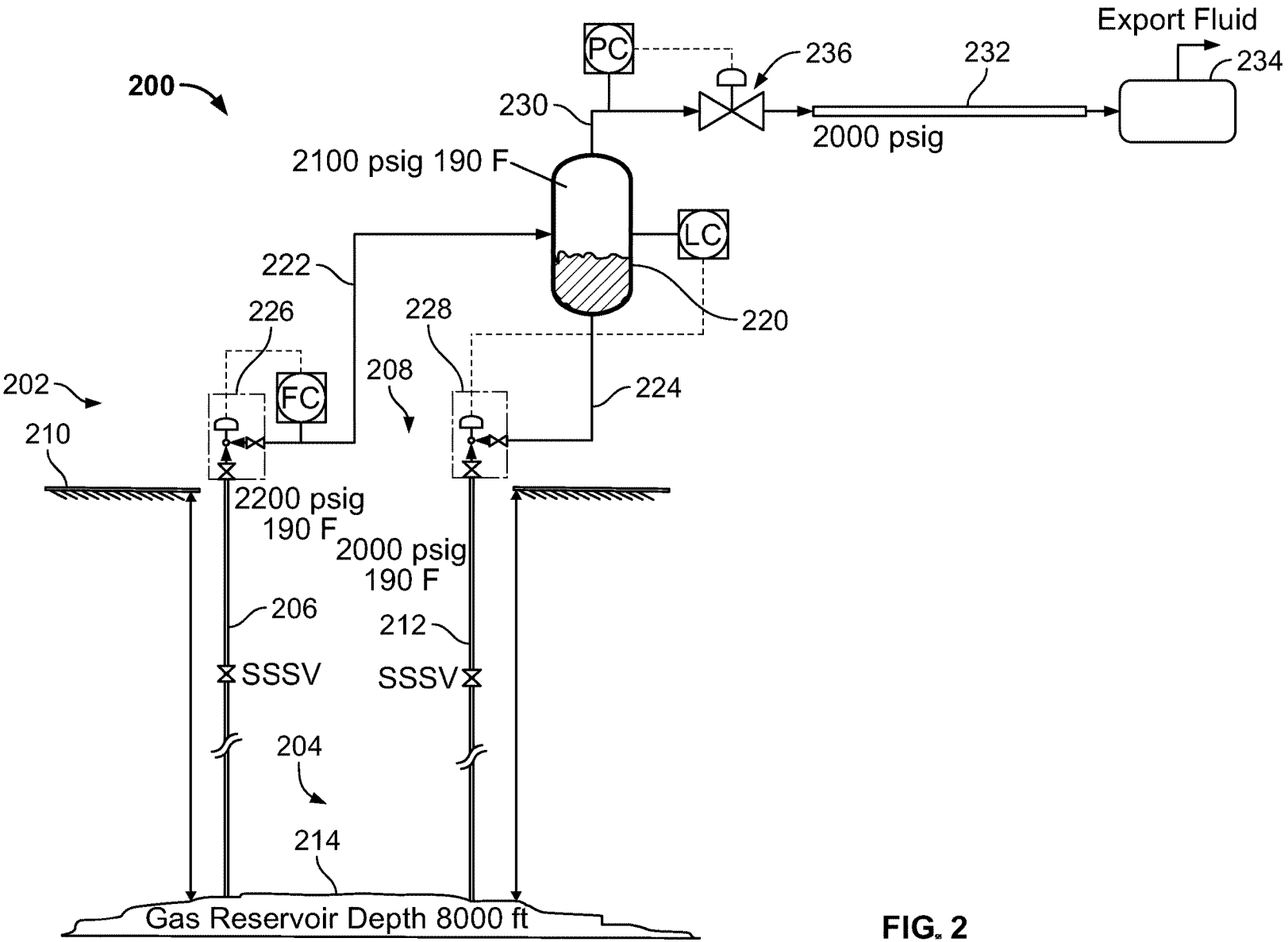
FIGS. 2-9 are schematic diagrams of example water separation systems connected to well systems.

FIG. 2 is a schematic diagram of an example water separation system 200 connected to a production well 204 of a well system 202. The production well 204 includes a production tubing 206 disposed within a wellbore of the production well 204, and a well head 208 positioned at an uphole end of the production tubing 206 and located at a surface 210 of the well 204. The production well 204 also includes an injection tubing 212 disposed within the wellbore of the well 204 and connected to the well head 208 at an uphole end of the injection tubing 212. While the example production well 204 of FIG. 2 shows the production tubing 206 and the injection tubing 212 as disposed within the same wellbore and coupled to the same well head 208, the production tubing 206 and injection tubing 212 can be disposed in different wellbores within the same well site. For example, the production tubing 206 can be disposed in a first, production wellbore, and the injection tubing 212 can be disposed in a second, injection wellbore different from the first production wellbore. The production tubing 206 and injection tubing 212 can be connected to the same well head 208 or to separate well heads. The production wellbore and the injection wellbore are part of the same well system such that the uphole end of the production tubing 206 and the uphole end of the injection tubing 212 are positioned on the same well site. The production tubing 206 and the injection tubing 212 access a subterranean reservoir 214, where the production tubing 206 flows a production fluid uphole from the reservoir 214, and the injection tubing 212 flows separated water downhole back into the reservoir 214.

The example well system 202 of FIG. 2 indicates the depth of the reservoir 214 as 8,000 feet (ft), however, the depth of the reservoir 214 can be a different depth, such as any depth up to and including 25,000 ft. Also, reservoir 214 of the example well system 202 of FIG. 2 is shown as a gas reservoir, however, the reservoir may be a liquid hydrocarbon reservoir, a gas hydrocarbon reservoir (such as an ethane gas reservoir), a two-phase reservoir with liquid and gas hydrocarbon components, or a different reservoir type. Further, while the example well system 202 and example water separation systems 200 of FIG. 2 provide example pressures of fluids at various stages in various components of the water separation system 200 or well system 202, these pressures can vary, for example, based on reservoir depth, environmental factors, or other factors. These example pressures are provided as examples, and may vary.

The example water separation system 200 includes a water separator 220 to separate water from the production fluid, for example, from the production tubing 206. The water separator 220 is located and positioned at the well site, for example, in close proximity to the production well 204 of the well system 202. The water separator 220 fluidly connects to the production tubing 206 with a production fluid pathway 222 that extends from the production tubing 206 to an input of the water separator 220, and fluidly connects to the injection tubing 212 with an injection fluid pathway 224 that extends from an output of the water separator 220 to the injection tubing 212. The production fluid pathway 222, injection fluid pathway, or both, include a pipeline or tubing, where the production fluid pathway 222 direct the flow of production fluid from the production tubing 206 to the water separator 220, and the injection fluid pathway 224 directs the flow of separated water from the water separator 220 to the injection tubing 212.

The example water separation system 200 includes a production control valve 226 fluidly connected to the production tubing 206 and the production fluid pathway 222, and is positioned at an uphole end of the production tubing 206, for example, at the well head 208 of the well system 202. The production control valve 226 controls the flow of the production fluid from the production tubing 206 as it flows into and through the production fluid pathway 222. The example water separation system 200 also includes an injection control valve 228 fluidly connected to the injection tubing 212 and the injection fluid pathway 224, and is positioned at an uphole end of the injection tubing 212, for example, at the well head 208 of the well system 202. The injection control valve 228 controls the flow of the separated water from the water separator 220 as it through the injection fluid pathway 224 and into the injection tubing 212. In some examples, the production control valve 226, the injection control valve 228, or both, take the form of a choke valve that can vary the flow of a fluid by opening (partially or completely) or closing (partially or completely) the respective valve.

The water separation system 200 includes an output fluid pathway 230 fluidly connected to an outlet of the water separator 220. The output fluid pathway 230 receives the output production fluid after all or a portion of the water component is removed from the production fluid that enters the water separator 220. The output fluid pathway 230 directs the output production fluid out of the water separator 220, for example, to a downstream pipeline 232 leading to a hydrocarbon processing facility 234, other processing facility type, or a different destination.

The example water separation system 200 of FIG. 2 includes a second stage production control valve 236 disposed within the output fluid pathway 230 and positioned downstream of the water separator 220. The second stage production control valve 236 acts to control a pressure within the water separator 220 and the flow of the output production fluid in the output fluid pathway 230, for example, by varying the opening and closing of the valve 236. In some instances, the second stage production control valve 236 includes a choke valve. The water separator 220 of the example water separation system 200 is shown in FIG. 2 as a KOD, however, the water separator 220 can take a variety of other forms. For example, the water separator 220 can include an in-line cyclonic water separator (described later), hydrocyclone, in-line separator, two-phase horizontal or vertical vessel separator, three-phase horizontal or vertical vessel separator, centrifugal separator, a combination of these, or another type of water separator or fluid separator.

In some implementations, the operating pressure of the separated water in the injection fluid pathway 224 from the KOD is around 2,100 pound per square inch gauge (psig) and the operating temperature is about 190 degrees Fahrenheit (F). However, the operating pressure of the KOD can vary, for example, between 300 psig and 8,000 psig depending on the pressures in the reservoir, in the corresponding pipelines, or both. A desired injection pressure at the level of the reservoir 214 is about 500 to 600 psi above the reservoir pressure, in order for injection to be sufficiently successful. For example, if the pressure in the reservoir 214 is about 2500 psig, the injection pressure of the water at the level of the reservoir should be about 3000 psig or greater. In the example water separation system 200 of FIG. 2, the pressure of the separated water from the water separator 220, or KOD, is about 2000 psig. This pressure of the separated water, factoring in the depth of the reservoir from the surface and a specific gravity of the separated water, would amount to a total pressure at the reservoir level of about 5,290 psig, which is more than sufficient for injection in the reservoir 214, for example, without requiring any additional pumps to boost a pressure of the separated water in preparation for injection back into the reservoir 214.

Figure 3:
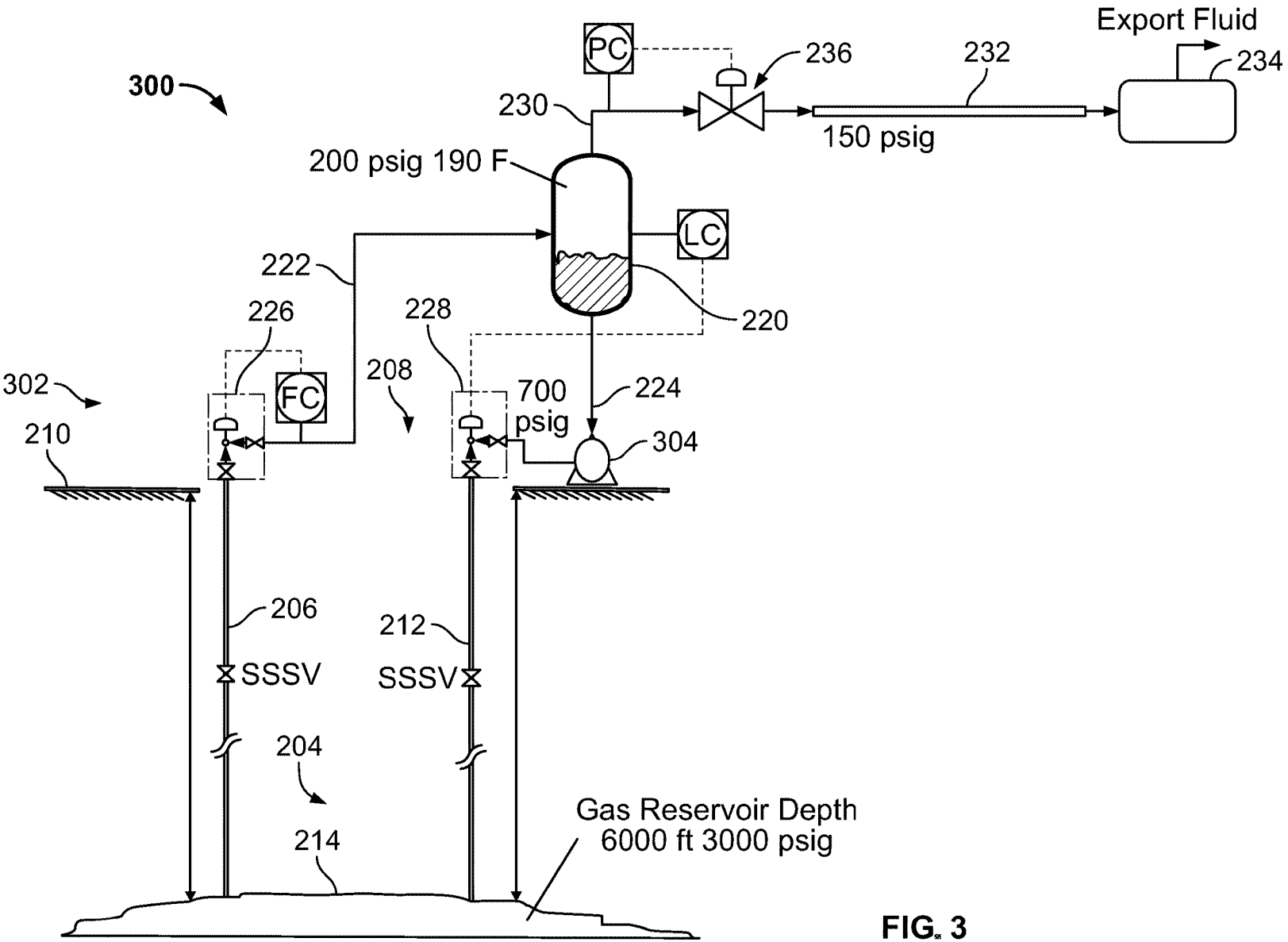

FIG. 3 is a schematic diagram of an example water separation system 300 connected to a well system 302. The example water separation system 300 and example well system 302 are the same as the example water separation system 200 and example well system 202 of FIG. 2, except that the reservoir 214 has a depth of 6,000 ft and a pressure of 3,000 psig, and the example water separation system 300 includes a water injection pump 304 in the injection fluid pathway 224, for example, to boost a pressure of the separated water flow in the injection fluid pathway 224. The water injection pump 304 can increase a fluid pressure of the separated water in the injection fluid pathway 224.

For example, in instances where the water separator 220 operates at 200 psig or similar, the total pressure of the separated water at reservoir level without the water injection pump 304 would be about 2,620 psig. The water injection pump 304 can be utilized to increase the pressure of the separated water at the surface by about 500 psig, which would then increase the total pressure of the separated water at reservoir level above the pressure threshold of about 500 psig above reservoir pressure.

Figure 4:
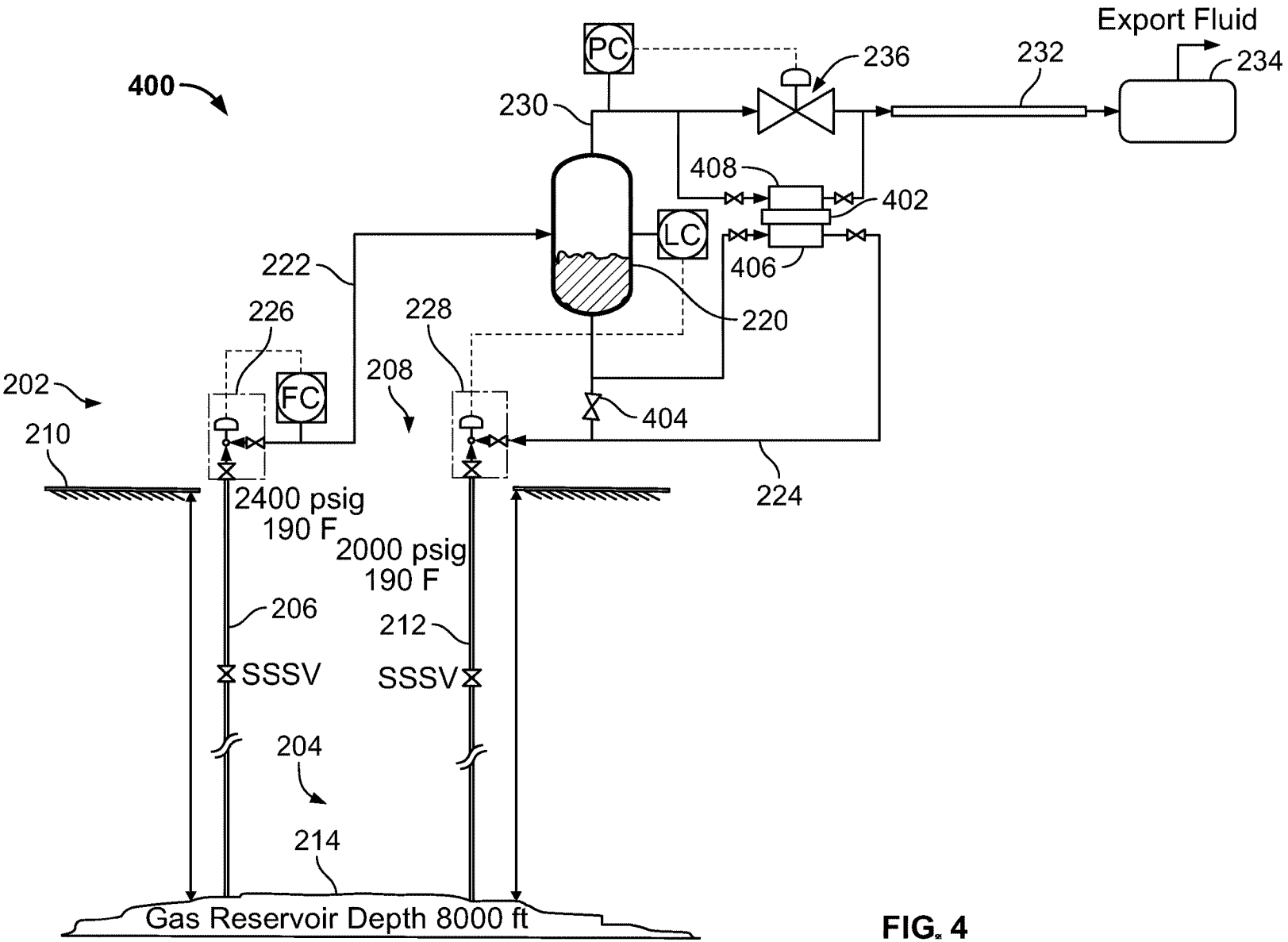

FIG. 4 is a schematic diagram of an example water separation system 400 connected to the example well system 202 of FIG. 2. The example water separation system 400 is the same as the example water separation system 200 of FIG. 2, except the example water separation system 400 includes a turbocharger 402 fluidly connected to the output fluid pathway 230 and the injection fluid pathway 224, and includes a bypass valve 404 in the injection fluid pathway 224.

The turbocharger 402 extracts energy from the flow of production fluid through the output fluid pathway 230 and transfers that energy to the separated water flow in the injection fluid pathway 224. The transferred energy can be used to boost a pressure of the separated water, for example, to reach a minimum pressure threshold sufficient for reinjection back into the reservoir 214. Alternatively, in some instances, the turbocharger 402 can be used to extract energy from the flow of separated water in the injection fluid pathway 224 and transfers that energy to the flow of production fluid through the output fluid pathway 230. In these instances, the separated water can still have a sufficient pressure for reinjection, while transferring excess pressure to the flow of production fluid through the output fluid pathway 230, for example, in instances where the production fluid is expected to traverse considerable distance along the pipeline 232 and experience considerable drops in pressure in the pipeline 232.

In the example water separation system 400 of FIG. 4, the turbocharger 402 is fluidly connected to the injection fluid pathway 224 and to the output fluid pathway 230. For example, the turbocharger 402 includes a pump section 406 and a turbine section 408 rotatably coupled to the pump section 406 such that a pump rotor of the pump section 406 rotates with a turbine rotor of the turbine section 408. The turbine section 408 receives a flow of fluid, such as the production fluid from the output fluid pathway 230, and the flow of the production fluid drives rotational movement of the turbine section 408. The pump section 406 is fluidly connected to the separated water flow in the injection fluid pathway 224, and imparts the rotational movement of the pump rotor to the separated water to boost the pressure of the flow of separated water.

In certain implementations, the turbine section 408 and the pump section 406 are switched, in that energy from the flow of separated water is extracted using the turbine section 408, and the extracted energy is imparted on the production fluid flow using the pump section 406.

In some examples, such as in the example water separation system of FIG. 4, the turbocharger 402 is disposed in the output fluid pathway 230 in a parallel configuration with the second stage production control valve 236. This parallel configuration of the turbocharger 402 and second stage production control valve 236 in the output fluid pathway 230 allows for the turbocharger 402 to be utilized or bypassed (via the second stage production control valve 236) as the output production fluid flows through the output fluid pathway 230, as desired or as needed for controlling the fluid pressures within the output fluid pathway 230, injection fluid pathway 224, or both.

The example water separation system of FIG. 4 also includes the bypass valve 404 in the injection fluid pathway 224 in a parallel configuration with the turbocharger 402. This parallel configuration of the turbocharger 402 and the bypass valve 404 in the injection fluid pathway 224 allows for the turbocharger 402 to be utilized or bypassed as the separated water flows through the injection fluid pathway 224, as desired or as needed for controlling the fluid pressures within the injection fluid pathway 224, output fluid pathway 230, or both.

Figure 5:
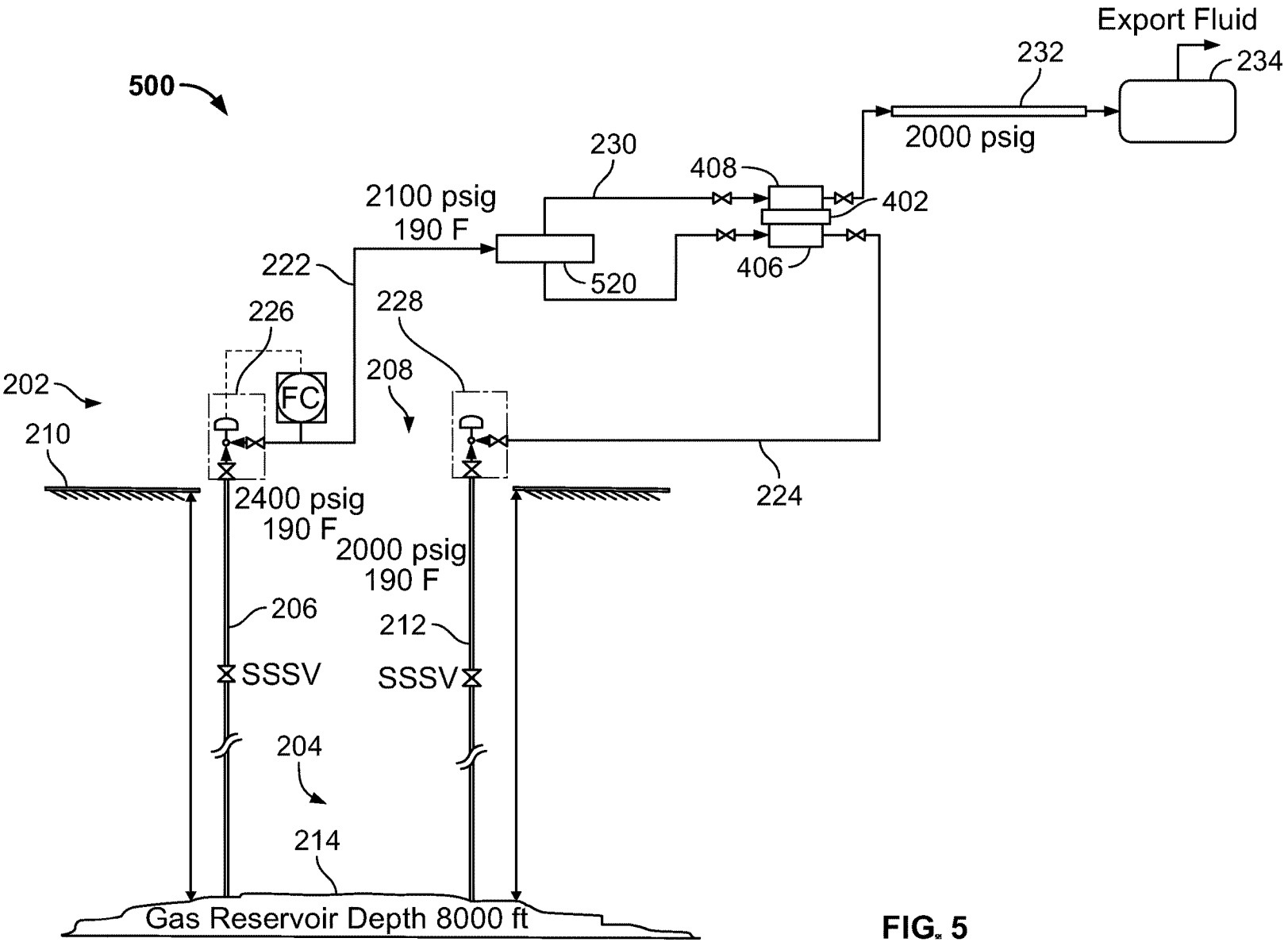

FIG. 5 is a schematic diagram of an example water separation system 500 connected to the example well system 202 of FIG. 2. The example water separation system 500 is the same as the example water separation system 200 of FIG. 2, except the example water separation system 500 includes the turbocharger 402 of the example water separation system 400 of FIG. 4, the water separator 520 takes the form of an inline cyclonic separator, and the output fluid pathway 230 excludes the second stage production control valve 236.

Figure 6:
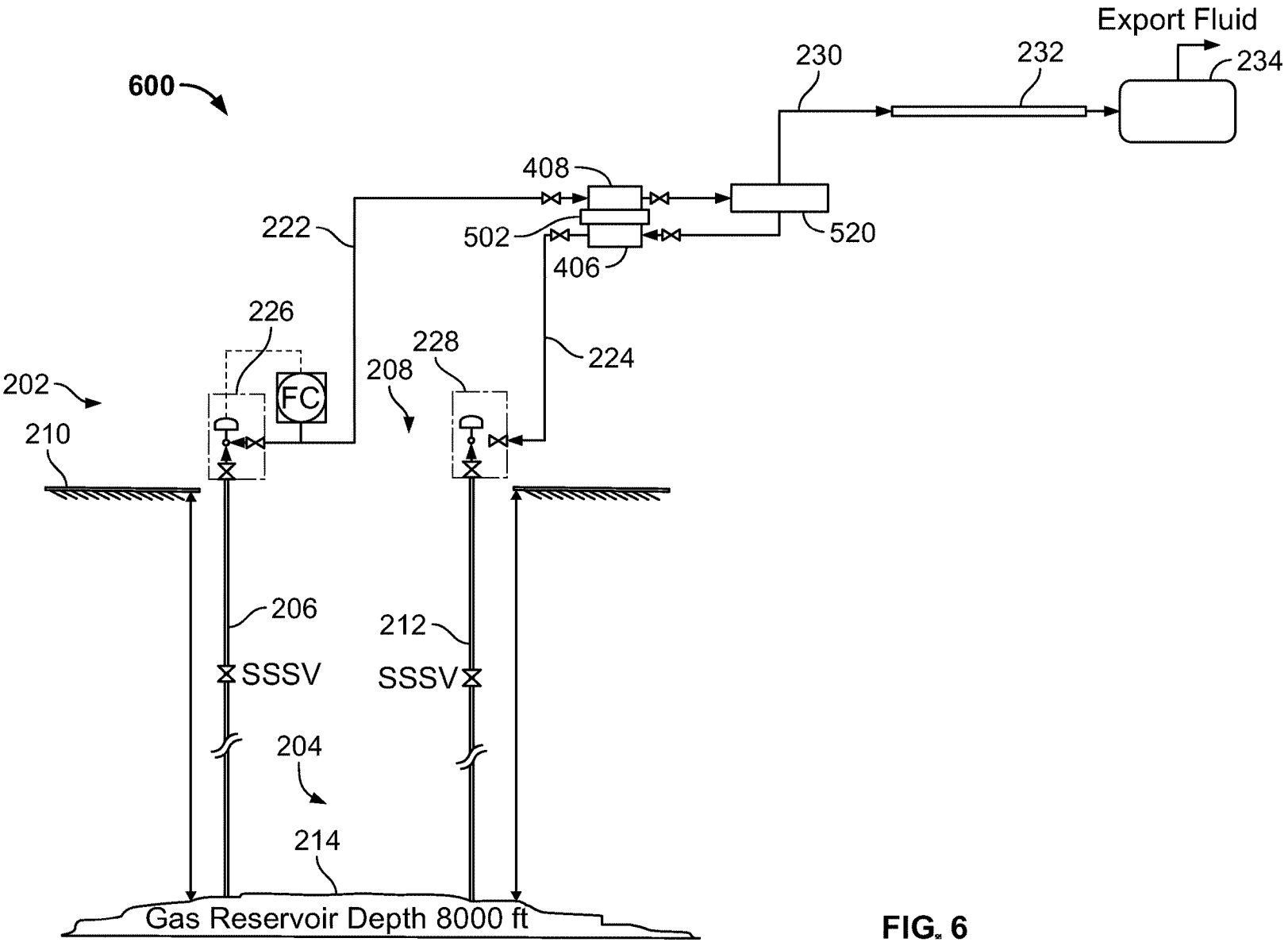

FIG. 6 is a schematic diagram of an example water separation system 600 connected to the example well system 202 of FIG. 2. The example water separation system 600 is the same as the example water separation system 500 of FIG. 5, except that the turbocharger 502 of the example system 600 of FIG. 6 is fluidly connected to the production fluid pathway 222 instead of the output fluid pathway 230. The turbocharger 502 operates the same way as the turbocharger 402 of FIGS. 4 and 5, other than that the turbine section 408 (or pump section 406) is fluidly connected to the production fluid flow in the production fluid pathway 222.

Figure 7:
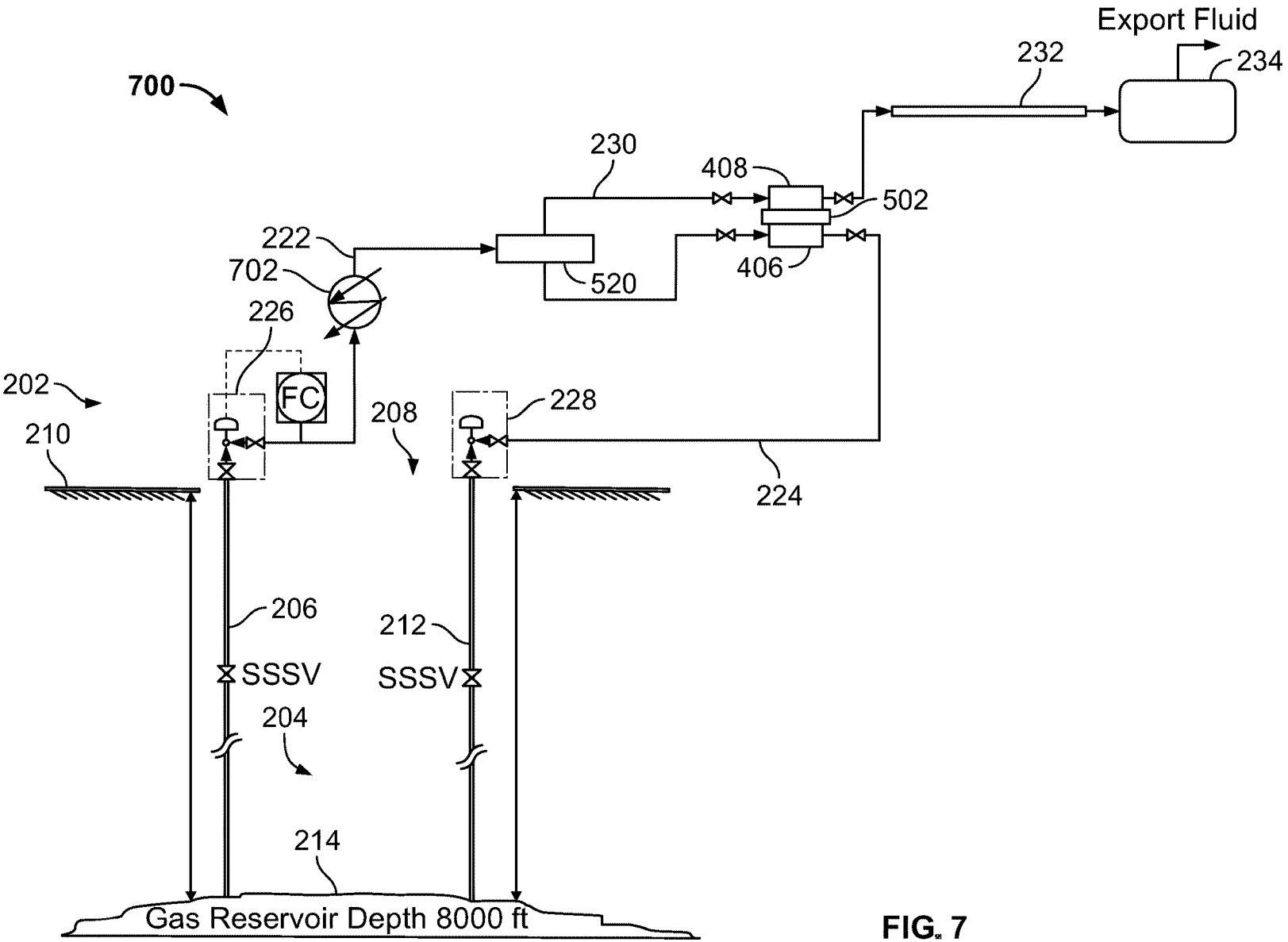

FIG. 7 is a schematic diagram of an example water separation system 700 connected to the example well system 202 of FIG. 2. The example water separation system 700 is the same as the example water separation system 500 of FIG. 5, except that the example water separation system 700 includes a cooler 702 along the production fluid pathway 222 upstream of the water separator 520. The cooler 702 acts to decrease a temperature of the production fluid in the production fluid pathway 222, for example, to condense more water and consequently dehydrate the hydrocarbon component of the production fluid for a more efficient and more complete separation of the water component from the remainder of the production fluid at the water separator 520. The cooler 702 is positioned along the production fluid pathway 222 between the production control valve 226 and the water separator 520, such that the cooler 702 cools the production fluid before it enters the water separator 520.

The cooler 702 can take a variety of different forms. In some instances, the cooler 702 includes a heat exchanger with a first side in contact with the production fluid and a second side of the tube heat exchanger in contact with a cooling media having a lower temperature than the production fluid. The cooling media can include a water stream, a refrigerant, ambient air, or other cooling media. In some examples, the cooler 702 includes an air cooler that uses natural draft air, induced draft air, forced draft air, or a combination of these to cool the production fluid in the production fluid pathway 222.

Figure 8:
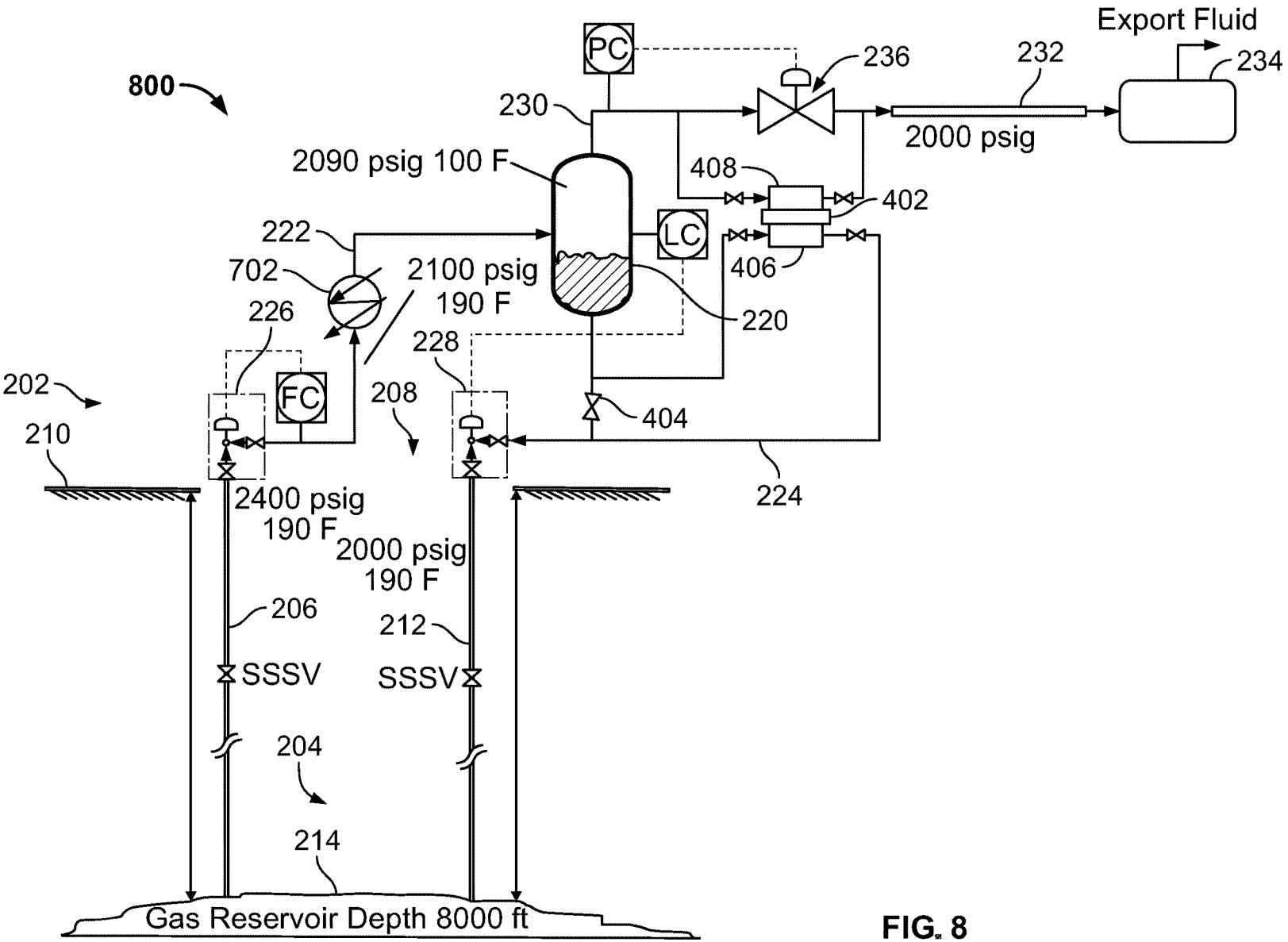

FIG. 8 is a schematic diagram of an example water separation system 800 connected to the example well system 202 of FIG. 2. The example water separation system 800 is the same as the example water separation system 400 of FIG. 4, except that the example water separation system 800 includes the cooler 702 along the production fluid pathway 222 upstream of the water separator 220.

The cooler 702 is provided in the example water separation system 700 of FIG. 7 and the example water separation system 800 of FIG. 8. The cooler 702 may also be included in other example water separation systems of this disclosure.

Figure 9:
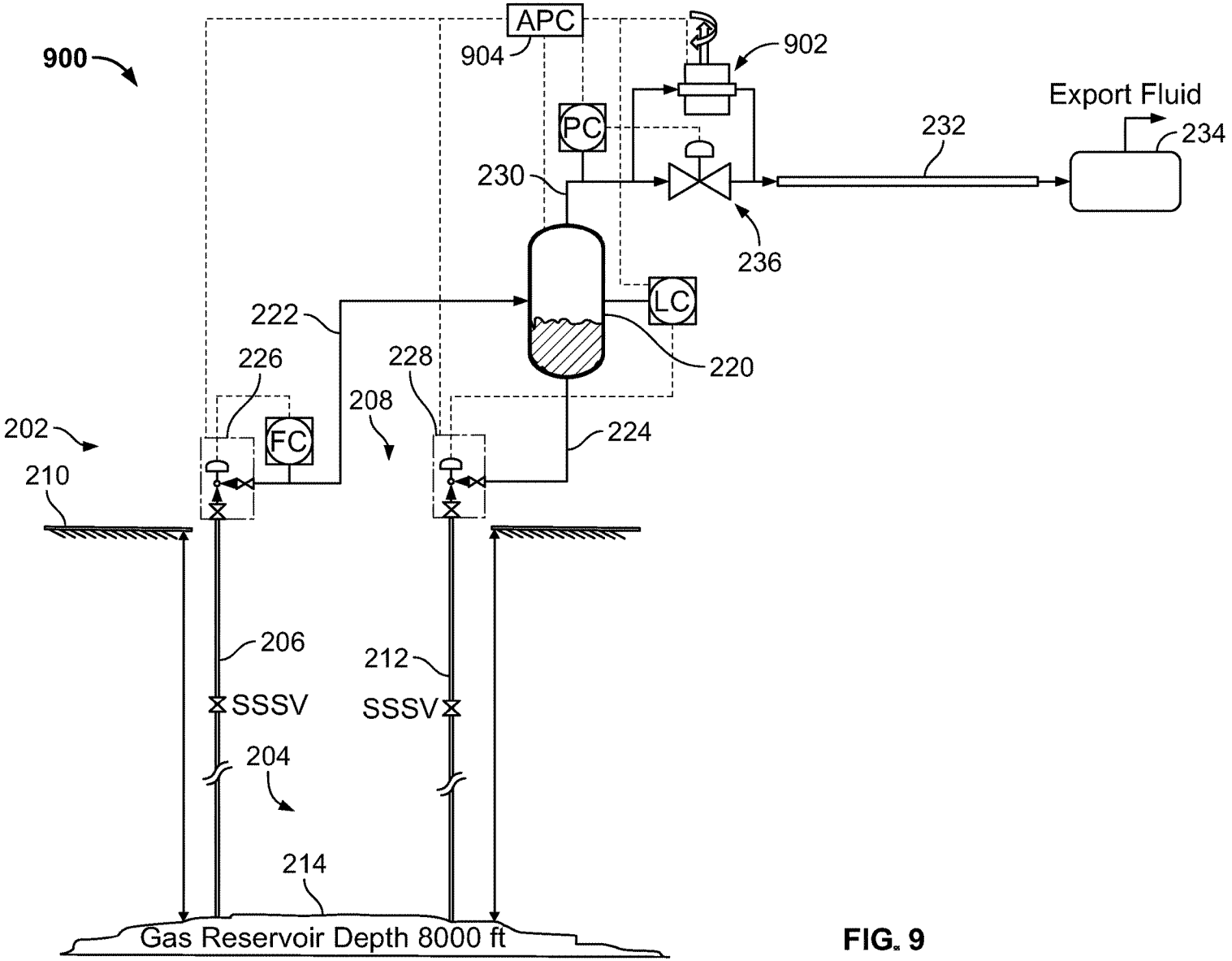

FIG. 9 is a schematic diagram of an example water separation system 900 connected to the example well system 202 of FIG. 2. The example water separation system 900 is the same as the example water separation system 200 of FIG. 2, except that the example water separation system 900 includes a hydraulic power recovery turbine (HPRT) 902 fluidly connected to the output fluid pathway 230 in a parallel configuration with the second stage production control valve 236.

The HPRT 902 harnesses the pressure drop of the output production fluid along the output fluid pathway 230, and generates electrical energy from the pressure drop in the flow of the output production fluid through the output fluid pathway 230. The HPRT 902 recovers energy from some or all of the output production fluid along the output fluid pathway 230 by reducing the pressure of the fluid. An example HPRT 902 can include a reverse-rotating centrifugal pump that recovers energy from a higher-pressure process liquid by reducing its pressure that may otherwise be wasted across throttle valves. The HPRT 902 can include a horizontal or vertical type, single stage or multistage type, or overhung or between-bearing type. The materials making up the HPRT 902 do not require special metallurgy. For example, the materials of the HPRT 902 can include carbon steel, stainless steel, chrome, a combination of these, or other materials.

In some implementations, the HPRT 902 acts as a pump with a reverse rotation, and a higher inlet pressure of a fluid relative to a lower outlet pressure of the fluid. The rotation of a rotor within the HPRT 902, which rotate in response to the high pressure fluid engaging and causing blades or vanes along the rotor to rotate, is used to generate energy, such as electrical energy when the rotor rotates relative to a stator An HPRT 902 operates near at Best Efficiency Point (BEP). In some implementations, at a point below the BEP of the HPRT 902, the capability of the HPRT 902 to recover energy may diminish and the HPRT 902 becomes a drag on the fluid system. In some examples, the amount of electrical power recovered by the HPRT 902 can be calculated with equation 1, below:

$$HP = \frac{Q \times H \times SG \times E}{3960} \tag{1}$$

where HP is the energy recovered by the HPRT 902, Q is the turbine capacity in gallons per minute (gpm), H is the differential head across the HPRT 902 in units of feet (ft), SG is the specific gravity of liquid, and E is the HPRT efficiency decimal.

The parallel configuration of the HPRT 902 with the second stage production control valve 236 allows for the HPRT 902 to be utilized in part, utilized in full, or bypassed entirely as the output production fluid flows along the output fluid pathway 230.

Figure 10:
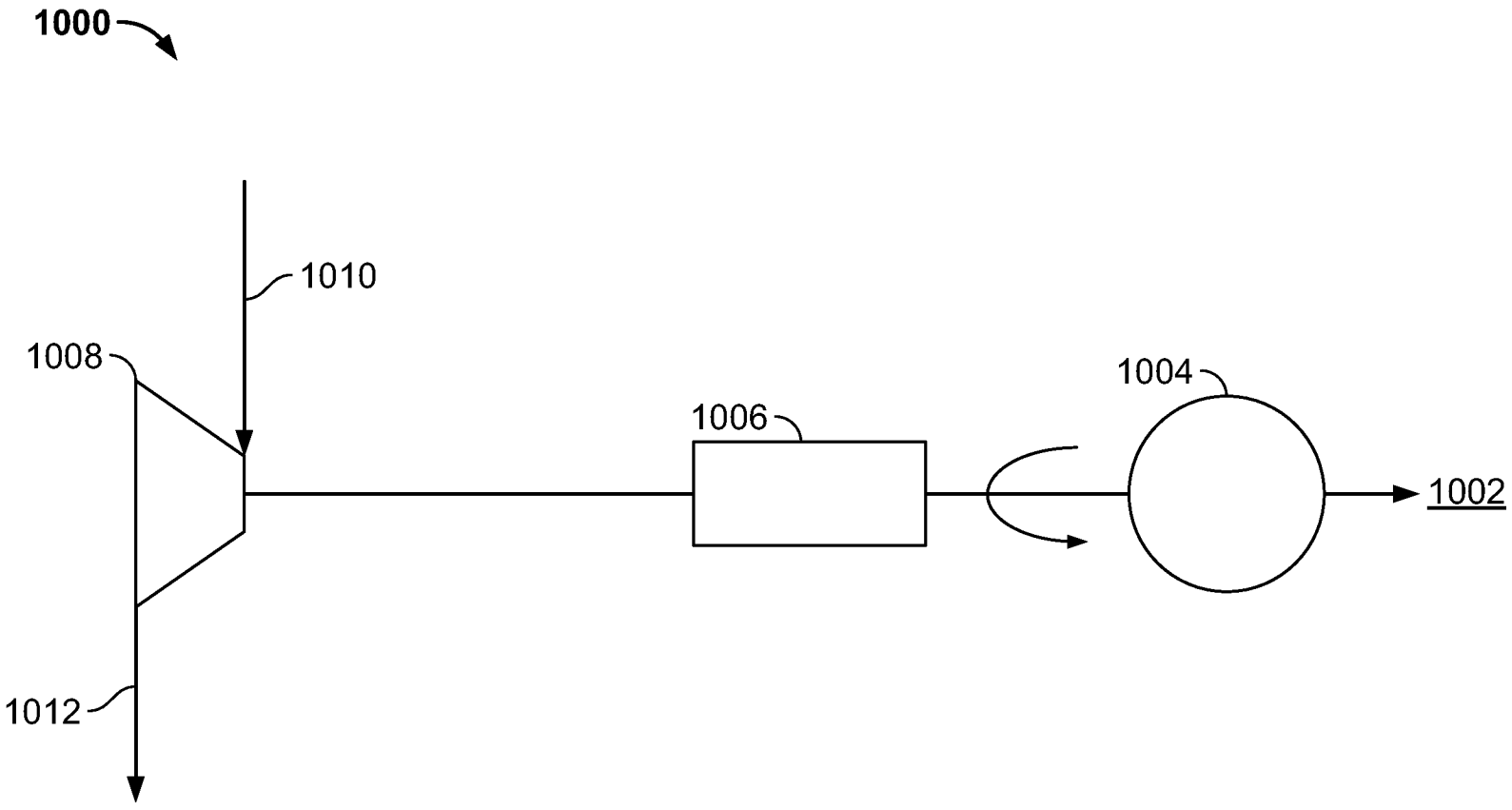
FIG. 10 is a schematic view of an example hydraulic power recovery turbine system that can be used in the hydraulic power recovery turbine of FIG. 9.

FIG. 10 is a schematic view of an example HPRT system 1000 that can be used in the HPRT 902 of the example system 900 of FIG. 9. The arrangement of example HPRT system 1000 includes a driven equipment 1002 (such as a separate drivable unit that uses or otherwise receives recovered power or energy), an electric motor 1004 or generator with a double-extended shaft, a clutch 1006, and an HPRT 1008. An input fluid 1010 enters the HPRT 1008 and flows through the HPRT 1008 while rotating a rotor within the HPRT 1008. The output fluid 1012 exits the HPRT 1008 after engaging the rotor of the HPRT 1008. In instances where the HPRT 1008 is in operation, the input fluid 1010 has a higher pressure than the output fluid 1012 since the HPRT 1008 captures energy via the pressure drop between the input fluid 1010 and the output fluid 1012. In the example HPRT system 1000 of FIG. 10, the clutch 1006 selectively connects or disconnects the HPRT 1008 to the electric motor 1004. For example, the clutch 1006 may disconnect the HPRT 1008 from the electric motor 1004 in instances where the input fluid 1010 is unavailable or its pressure becomes too low, in order to avoid the HPRT 1008 from becoming a drag on the example system 1000. When the clutch 1006 connects the HPRT 1008 to the electric motor 1004, the electric motor 1004 generates energy. When the clutch 1006 disconnects the HPRT 1008 from the electric motor 1004, the electric motor 1004 does not generate energy.

In some instances, such as in the example water separation system 900 of FIG. 9, the example water separation system 900 includes an advanced process control (APC) for controlling the operation of the system 900 and flow of fluids through the system 900. The APC 904 can include a computer or controller that receives input from components of the example water separation system 900 and determine a desired operation of the example system 900. For example, the APC 904 can determine, based on a pressure of the production fluid in the output fluid pathway 230, whether and how to operate the HPRT 902. In some instances, the APC 904 can be incorporated into any one or more of the example water separation systems 200, 300, 400, 500, 600, 700, 800, 900 of FIGS. 2-9, for example, to control individual components of the respective systems, the overall operation of the respective systems, or both. For example, an example APC implemented in the example water separation system 400, 500, 600, 700, or 800 of FIGS. 4-8 can control the operation of the turbocharger 402, 502 and the flow of fluid through either side of the turbocharger 402, 502.

The APC 904 includes and uses model predictive controllers in combination with machine learning and artificial intelligence to monitor and control the overall performance of the example system 900, for example, while manipulating the opening and flow of fluid through the production control valve 226, the injection control valve 228, fluid flow and fluid level of the separator 220, fluid pressure in the separator 220, power generated from the HPRT 902, a combination of these, or other controllable aspects of the example system 900. For example, the APC 904 can detect characteristics of the flow in the separator 220, production pathway 222, injection pathway 224, output fluid pathway 230, or a combination of these, and control the flow of fluid through the water separator 220, through the output fluid pathway 230, or both, based on the detected characteristics. For example, if the APC 904 detects a pressure of the fluid in the output fluid pathway 230 upstream of the HPRT 902 that is below a threshold pressure value, the APC can control the example system 900 such that the production fluid flows through the second stage production valve 236 and bypasses the HPRT 902 in full or in part.

The prediction models for certain process variables can be built using mechanistic models, by experiment, by using the artificial intelligence of the historical data, or a combination of these. These process variables can include production fluid flow through the 230, pressure in the separator 220, power generation or recovery at the HPRT 902 (or turbocharger), production control valve 226 opening, fluid level in the separator 220, injection flow through the injection control valve 228, or other variables. The APC 904 can be utilized to avoid violating certain hard constraints, like carbon deposition on the anode.

Figure 11:
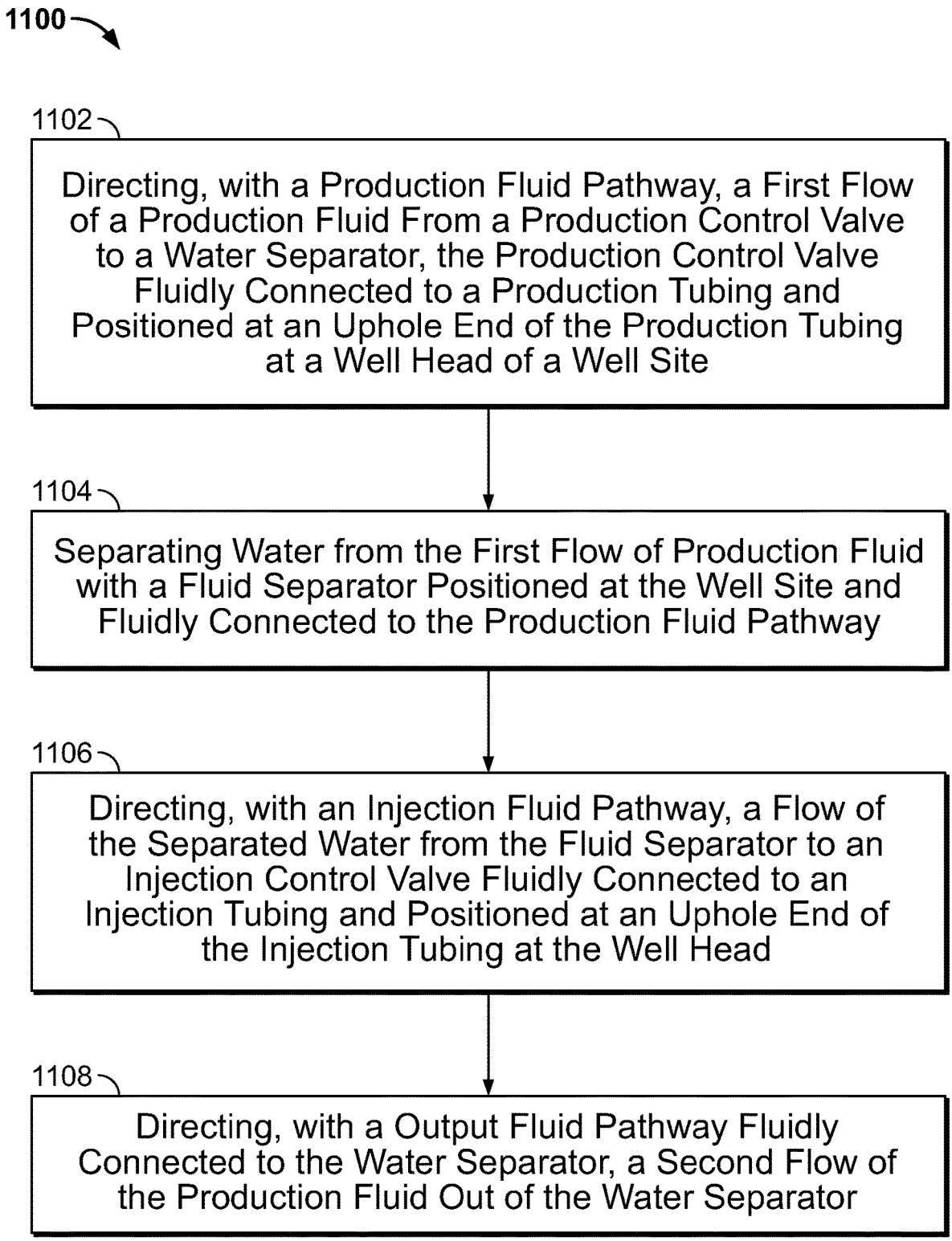
FIG. 11 is a flowchart describing an example method for water separation at a well site.

FIG. 11 is a flowchart describing an example method 1100 for water separation at a well site, for example, performed by any of the example water separation systems 200, 300, 400, 500, 600, 700, 800, 900 of FIGS. 2-9. At 1102, a production fluid pathway directs a first flow of a production fluid from a production control valve to a water separator. The production control valve is fluidly connected to a production tubing and positioned at an uphole end of the production tubing at a well head of a well site. At 1104, a fluid separator separates water from the first flow of production fluid. The fluid separator is positioned at the well site and is fluidly connected to the production fluid pathway. At 1106, an injection fluid pathway directs a flow of the separated water from the fluid separator to an injection control valve fluidly connected to an injection tubing and positioned at an uphole end of the injection tubing at the well head. At 1108, an output fluid pathway fluidly connected to the water separator directs a second flow of the production fluid out of the water separator.

In some implementations, a pressure of the second flow of production fluid in the output fluid pathway is controlled with a second stage production control valve positioned in the output fluid pathway downstream of the water separator. The fluid separator can include a knock out drum, an in-line cyclonic separator, or another type of fluid separator. In some examples, the in-line cyclonic separator is a compact separator that can provide benefits in crowded installations, such as in offshore hydrocarbon well sites. Directing the flow of separated water from the fluid separator to the injection control valve can include boosting a pressure of the portion of the flow of separated water in the injection fluid pathway with a turbocharger. The turbocharger can be fluidly connected to the injection fluid pathway and to the output fluid pathway, and the turbocharger can act to extract energy from the second flow of production fluid in the output fluid pathway and transfer the extracted energy to the portion of the flow of separated water. In some instances, the turbocharger can be fluidly connected to the injection fluid pathway and to the production fluid pathway, and can act to extract energy from the first flow of production fluid in the production fluid pathway and transfer the extracted energy to the portion of the flow of separated water. In certain implementations, a portion of the second flow of the production fluid is directed to a hydraulic recovery turbine disposed in the output fluid pathway, where the hydraulic recovery turbine can generate electrical energy from a pressure drop in the second flow of the production fluid through the output fluid pathway. The generated electrical energy from the hydraulic recovery turbine can be directed to an electrical component of the well head of the well site, or to other components.

Figure 12:
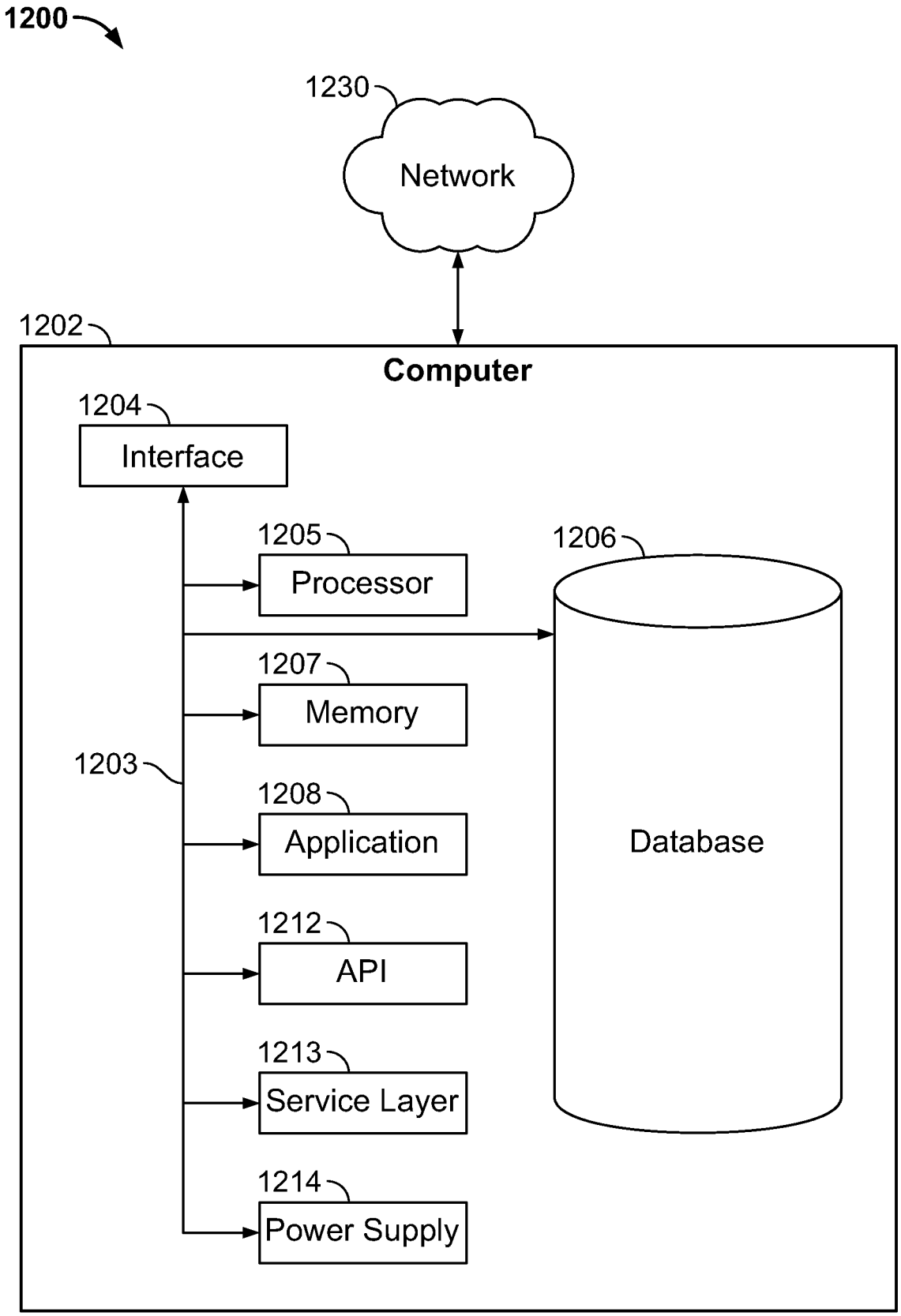
FIG. 12 is a block diagram illustrating an example computer system used to provide computational functionalities associated with described algorithms, methods, functions, processes, flows, and procedures as described in the present disclosure, according to some implementations of the present disclosure.

FIG. 12 is a block diagram of an example computer system 1200 used to provide computational functionalities associated with described algorithms, methods, functions, processes, flows, and procedures described in the present disclosure, according to some implementations of the present disclosure. For example, the example computer system 1200 can be used in the APC 904 of the example system 900 of FIG. 9. The illustrated computer 1202 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 1202 can include input devices such as keypads, keyboards, and touch screens that can accept user information. Also, the computer 1202 can include output devices that can convey information associated with the operation of the computer 1202. The information can include digital data, visual data, audio information, or a combination of information. The information can be presented in a graphical user interface (UI) (or GUI).

The computer 1202 can serve in a role as a client, a network component, a server, a database, a persistency, or components of a computer system for performing the subject matter described in the present disclosure. The illustrated computer 1202 is communicably coupled with a network 1230. In some implementations, one or more components of the computer 1202 can be configured to operate within different environments, including cloud-computing-based environments, local environments, global environments, and combinations of environments.

At a high level, the computer 1202 is an electronic computing device operable to receive, transmit, process, store, and manage data and information associated with the described subject matter. According to some implementations, the computer 1202 can also include, or be communicably coupled with, an application server, an email server, a web server, a caching server, a streaming data server, or a combination of servers.

The computer 1202 can receive requests over network 1230 from a client application (for example, executing on another computer 1202). The computer 1202 can respond to the received requests by processing the received requests using software applications. Requests can also be sent to the computer 1202 from internal users (for example, from a command console), external (or third) parties, automated applications, entities, individuals, systems, and computers.

Each of the components of the computer 1202 can communicate using a system bus 1203. In some implementations, any or all of the components of the computer 1202, including hardware or software components, can interface with each other or the interface 1204 (or a combination of both), over the system bus 1203. Interfaces can use an application programming interface (API) 1212, a service layer 1213, or a combination of the API 1212 and service layer 1213. The API 1212 can include specifications for routines, data structures, and object classes. The API 1212 can be either computer-language independent or dependent. The API 1212 can refer to a complete interface, a single function, or a set of APIs.

The service layer 1213 can provide software services to the computer 1202 and other components (whether illustrated or not) that are communicably coupled to the computer 1202. The functionality of the computer 1202 can be accessible for all service consumers using this service layer. Software services, such as those provided by the service layer 1213, can provide reusable, defined functionalities through a defined interface. For example, the interface can be software written in JAVA, C++, or a language providing data in extensible markup language (XML) format. While illustrated as an integrated component of the computer 1202, in alternative implementations, the API 1212 or the service layer 1213 can be stand-alone components in relation to other components of the computer 1202 and other components communicably coupled to the computer 1202. Moreover, any or all parts of the API 1212 or the service layer 1213 can be implemented as child or sub-modules of another software module, enterprise application, or hardware module without departing from the scope of the present disclosure.

The computer 1202 includes an interface 1204. Although illustrated as a single interface 1204 in FIG. 12, two or more interfaces 1204 can be used according to particular needs, desires, or particular implementations of the computer 1202 and the described functionality. The interface 1204 can be used by the computer 1202 for communicating with other systems that are connected to the network 1230 (whether illustrated or not) in a distributed environment. Generally, the interface 1204 can include, or be implemented using, logic encoded in software or hardware (or a combination of software and hardware) operable to communicate with the network 1230. More specifically, the interface 1204 can include software supporting one or more communication protocols associated with communications. As such, the network 1230 or the interface's hardware can be operable to communicate physical signals within and outside of the illustrated computer 1202.

The computer 1202 includes a processor 1205. Although illustrated as a single processor 1205 in FIG. 12, two or more processors 1205 can be used according to particular needs, desires, or particular implementations of the computer 1202 and the described functionality. Generally, the processor 1205 can execute instructions and can manipulate data to perform the operations of the computer 1202, including operations using algorithms, methods, functions, processes, flows, and procedures as described in the present disclosure.

The computer 1202 also includes a database 1206 that can hold data for the computer 1202 and other components connected to the network 1230 (whether illustrated or not). For example, database 1206 can be an in-memory, conventional, or a database storing data consistent with the present disclosure. In some implementations, database 1206 can be a combination of two or more different database types (for example, hybrid in-memory and conventional databases) according to particular needs, desires, or particular implementations of the computer 1202 and the described functionality. Although illustrated as a single database 1206 in FIG. 12, two or more databases (of the same, different, or combination of types) can be used according to particular needs, desires, or particular implementations of the computer 1202 and the described functionality. While database 1206 is illustrated as an internal component of the computer 1202, in alternative implementations, database 1206 can be external to the computer 1202.

The computer 1202 also includes a memory 1207 that can hold data for the computer 1202 or a combination of components connected to the network 1230 (whether illustrated or not). Memory 1207 can store any data consistent with the present disclosure. In some implementations, memory 1207 can be a combination of two or more different types of memory (for example, a combination of semiconductor and magnetic storage) according to particular needs, desires, or particular implementations of the computer 1202 and the described functionality. Although illustrated as a single memory 1207 in FIG. 12, two or more memories 1207 (of the same, different, or combination of types) can be used according to particular needs, desires, or particular implementations of the computer 1202 and the described functionality. While memory 1207 is illustrated as an internal component of the computer 1202, in alternative implementations, memory 1207 can be external to the computer 1202.

The application 1208 can be an algorithmic software engine providing functionality according to particular needs, desires, or particular implementations of the computer 1202 and the described functionality. For example, application 1208 can serve as one or more components, modules, or applications. Further, although illustrated as a single application 1208, the application 1208 can be implemented as multiple applications 1208 on the computer 1202. In addition, although illustrated as internal to the computer 1202, in alternative implementations, the application 1208 can be external to the computer 1202.

The computer 1202 can also include a power supply 1214. The power supply 1214 can include a rechargeable or non-rechargeable battery that can be configured to be either user- or non-user-replaceable. In some implementations, the power supply 1214 can include power-conversion and management circuits, including recharging, standby, and power management functionalities. In some implementations, the power-supply 1214 can include a power plug to allow the computer 1202 to be plugged into a wall socket or a power source to, for example, power the computer 1202 or recharge a rechargeable battery.

There can be any number of computers 1202 associated with, or external to, a computer system containing computer 1202, with each computer 1202 communicating over network 1230. Further, the terms "client," "user," and other appropriate terminology can be used interchangeably, as appropriate, without departing from the scope of the present disclosure. Moreover, the present disclosure contemplates that many users can use one computer 1202 and one user can use multiple computers 1202.

A number of implementations have been described. Nevertheless, it will be understood that various modifications may be made without departing from the spirit and scope of the disclosure.

What is claimed is:

1. A water separation system for a well, the water separation system comprising:

a production control valve fluidly connected to a production tubing and positioned at an uphole end of the production tubing at a well head of a well site;

a production fluid pathway between the production control valve and a water separator to direct a production fluid from the production control valve to the water separator;

an injection control valve fluidly connected to an injection tubing and positioned at an uphole end of the injection tubing at the well head;

an injection fluid pathway between the injection control valve and the water separator to direct separated water from the water separator to the injection control valve;

the water separator positioned at the well site and fluidly connected to the production fluid pathway and the injection fluid pathway, the water separator configured to receive the production fluid, separate water from the production fluid, and direct the separated water to the injection fluid pathway;

an output fluid pathway fluidly connected to the water separator to direct the production fluid out of the water separator; and a turbocharger fluidly connected to the injection fluid pathway and to one of the output fluid pathway or the production fluid pathway, the turbocharger configured to extract energy from the production fluid to boost a pressure of the separated water in the injection fluid pathway.

2. The water separation system of claim 1, further comprising a second stage production control valve positioned in the output fluid pathway downstream of the water separator, the second stage production control valve configured to control a pressure of the production fluid in the output fluid pathway.

3. The water separation system of claim 2, wherein the water separator comprises a knock out drum to separate water from the production fluid.

4. The water separation system of claim 3, further comprising a water injection pump in the injection fluid pathway between the knock out drum and the injection control valve, the water injection pump configured to increase a fluid pressure of the separated water in the injection fluid pathway.

5. The water separation system of claim 2, wherein the turbocharger is fluidly connected to the injection fluid pathway and to the output fluid pathway, the turbocharger configured to extract energy from the production fluid to boost a pressure of the separated water in the injection fluid pathway.

6. The water separation system of claim 5, wherein the turbocharger is disposed in the output fluid pathway in parallel with the second stage production control valve.

7. The water separation system of claim 5, wherein the turbocharger is disposed in the injection fluid pathway in parallel with a bypass valve in the injection fluid pathway.

8. The water separation system of claim 2, further comprising a hydraulic recovery turbine in the output fluid pathway, the hydraulic recovery turbine configured to generate electrical energy from a pressure drop in a flow of the production fluid through the output fluid pathway.

9. The water separation system of claim 8, wherein the hydraulic recovery turbine is disposed in the output fluid pathway in parallel with the second stage production control valve.

10. The water separation system of claim 1, wherein the water separator comprises an in-line cyclonic separator.

11. The water separation system of claim 1, wherein the turbocharger comprises a pump section and a turbine section rotatably coupled to the pump section, the turbine section configured to receive a flow of the production fluid, and the pump section configured to boost pressure of a flow of the separated water.

12. The water separation system of claim 1, wherein the turbocharger is fluidly coupled to the injection fluid pathway downstream of the water separator and fluidly coupled to the production fluid pathway upstream of the water separator.

13. The water separation system of claim 1, wherein the turbocharger is fluidly coupled to the injection fluid pathway downstream of the water separator and fluidly coupled to the output fluid pathway downstream of the water separator.

14. The water separation system of claim 1, comprising a cooler along the production fluid pathway upstream of the water separator, the cooler configured to decrease a temperature of the production fluid in the production fluid pathway.

15. The water separation system of claim 1, further comprising a process control unit communicably connected to the production control valve, the injection control valve, and the output fluid pathway to control a flow of fluid through the water separation system.

16. A method for water separation at a well site, the method comprising:

directing, with a production fluid pathway, a first flow of a production fluid from a production control valve to a fluid separator, the production control valve fluidly connected to a production tubing and positioned at an uphole end of the production tubing at a well head of a well site;

separating water from the first flow of production fluid with the fluid separator positioned at the well site and fluidly connected to the production fluid pathway;

directing, with an injection fluid pathway, a flow of the separated water from the fluid separator to an injection control valve fluidly connected to an injection tubing and positioned at an uphole end of the injection tubing at the well head, wherein directing the flow of the separated water from the fluid separator to the injection control valve comprises boosting, with a turbocharger, a pressure of at least a portion of the flow of separated water in the injection fluid pathway; and directing, with an output fluid pathway fluidly connected to the fluid separator, a second flow of the production fluid out of the fluid separator.

17. The method of claim 16, wherein directing the second flow of production fluid out of the fluid separator comprises controlling a pressure of the second flow of production fluid in the output fluid pathway with a second stage production control valve positioned in the output fluid pathway downstream of the fluid separator.

18. The method of claim 16, wherein separating water from the first flow of production fluid with the fluid separator comprises separating water from the first flow of production fluid with one of a knock out drum or an in-line cyclonic separator.

19. The method of claim 16, wherein the turbocharger is fluidly connected to the injection fluid pathway and to the output fluid pathway, and boosting the pressure of at least a portion of the flow of separated water in the injection fluid pathway comprises extracting energy from the second flow of production fluid in the output fluid pathway and transferring the extracted energy to the at least a portion of the flow of separated water with the turbocharger.

20. The method of claim 16, wherein the turbocharger is fluidly connected to the injection fluid pathway and to the production fluid pathway, and boosting the pressure of at least a portion of the flow of separated water in the injection fluid pathway comprises extracting energy from the first flow of production fluid in the production fluid pathway and transferring the extracted energy to the at least a portion of the flow of separated water with the turbocharger.

21. The method of claim 16, further comprising cooling, with a cooler along the production fluid pathway upstream of the fluid separator, the first flow of production fluid in the production fluid pathway.

22. The method of claim 16, wherein directing the second flow of the production fluid out of the fluid separator comprises directing at least a portion of the second flow of the production fluid to a hydraulic recovery turbine disposed in the output fluid pathway, the method comprising generating electrical energy from a pressure drop of the at least a portion of the second flow of the production fluid through the output fluid pathway.

23. The method of claim 22, further comprising directing the generated electrical energy from the hydraulic recovery turbine to an electrical component of the well head of the well site.

24. The method of claim 16, comprising controlling, with an advanced process controller connected to at least one of the production control valve, the injection control valve, or the output fluid pathway, the flow of fluid through the fluid separator and through the output fluid pathway.

25. A water separation system for a well, the water separation system comprising:

a production fluid pathway between a production tubing at a well head of a well site and a water separator, the production fluid pathway configured to direct a flow of production fluid from the production tubing to the water separator;

an injection fluid pathway between the water separator and an injection tubing at the well head of the well site, the injection fluid pathway configured to direct a flow of separated water from the water separator to the injection tubing;

the water separator positioned at the well site and fluidly connected to the production fluid pathway and the injection fluid pathway, the water separator configured to receive the flow of production fluid, separate water from the flow of production fluid, and direct the separated water to the injection fluid pathway;

an output fluid pathway fluidly connected to the water separator to direct the flow of production fluid out of the water separator;

a turbocharger fluidly connected to the injection fluid pathway and to one of the output fluid pathway or the production fluid pathway, the turbocharger configured to extract energy from the production fluid and boost a pressure of the separated water in the injection fluid pathway; and a process control unit communicably connected to the production fluid pathway, the injection fluid pathway, the water separator, the output fluid pathway, and the turbocharger, the process control unit configured to control a flow of fluid through the water separation system.

26. The water separation system of claim 25, further comprising a hydraulic recovery turbine fluidly connected to the output fluid pathway and communicably connected to the process control unit, the hydraulic recovery turbine configured to generate electrical energy from a pressure drop in a flow of production fluid through the output fluid pathway.

* * * * *